US006363677B1

(12) United States Patent
Chen et al.

(10) Patent No.: US 6,363,677 B1
(45) Date of Patent: Apr. 2, 2002

(54) SURFACE COVERING SYSTEM AND METHODS OF INSTALLING SAME

(75) Inventors: Hao A. Chen, Chadds Ford, PA (US); John M. Whispell, Sicklerville, NJ (US)

(73) Assignee: Mannington Mills, Inc., Salem, NJ (US)

( * ) Notice: Subject to any disclaimer, the term of this patent is extended or adjusted under 35 U.S.C. 154(b) by 0 days.

(21) Appl. No.: 09/546,255

(22) Filed: Apr. 10, 2000

(51) Int. Cl.[7] ..... E04F 15/02

(52) U.S. Cl. ..... 52/586.1; 52/384; 52/471; 52/586.2; 52/589.1; 52/747.11

(58) Field of Search ..... 52/384, 385, 390, 52/391, 392, 471, 586.1, 586.2, 589.1, 591.4, 747.11, 591.1, 592.1

(56) References Cited

U.S. PATENT DOCUMENTS

| | | | | | |
|---|---|---|---|---|---|
| 579,348 | A | * | 3/1897 | McPherson | 52/385 |
| 1,018,987 | A | * | 2/1912 | Philpot et al. | 52/177 |
| 1,361,501 | A | | 12/1920 | Schepmoes | |
| 1,840,974 | A | * | 1/1932 | Rockwell | 52/391 X |
| 1,946,646 | A | * | 2/1934 | Storm | 52/393 |
| 1,946,690 | A | | 2/1934 | Haines | |
| 2,027,292 | A | * | 1/1936 | Rockwell | 52/391 X |
| 2,142,305 | A | | 1/1939 | Davis | |
| 2,196,807 | A | * | 4/1940 | Eckert | 52/471 X |
| 2,204,675 | A | | 6/1940 | Grunert | |
| 2,231,780 | A | * | 2/1941 | Swenson | 52/390 |
| 2,269,926 | A | * | 1/1942 | Crooks | 52/390 |
| 2,569,902 | A | * | 10/1951 | Rienau et al. | 52/385 |
| 2,740,167 | A | | 4/1956 | Rowley | |
| 3,310,919 | A | | 3/1967 | Bue et al. | |
| 3,397,496 | A | | 8/1968 | Sohns | |
| 3,619,963 | A | | 11/1971 | Omholt | |
| 3,657,852 | A | | 4/1972 | Worthington et al. | |
| 3,694,983 | A | | 10/1972 | Couquet | |
| 3,946,529 | A | | 3/1976 | Chevaux | |
| 4,023,596 | A | | 5/1977 | Tate | |
| 4,226,064 | A | | 10/1980 | Kraayenhof | |

(List continued on next page.)

FOREIGN PATENT DOCUMENTS

| | | | | |
|---|---|---|---|---|
| CH | 276058 | * | 9/1951 | 52/471 |
| DE | 69234 | * | 6/1915 | 52/390 |
| DE | 127266 | * | 3/1932 | 52/390 |
| DE | 568170 | * | 1/1933 | 52/392 |
| DE | 33 43 601 A1 | | 12/1983 | |
| DE | 42 42 530 A1 | | 12/1992 | |
| DE | 299 11 462 U1 | | 12/1999 | |
| FR | 688530 | * | 8/1930 | 52/390 |
| GB | 812671 | * | 4/1959 | 52/392 |
| GB | 1 430 423 | | 3/1976 | |
| JP | 3-169967 | | 7/1982 | |
| JP | 57-119056 | | 7/1982 | |
| WO | WO 94/26999 | | 11/1994 | |
| WO | WO 97/21011 | | 6/1997 | |
| GB | 19 | * | 1/1896 | 52/591.4 |

*Primary Examiner*—Laura A. Callo
(74) *Attorney, Agent, or Firm*—Kilyk & Bowersox, PLLC

(57) ABSTRACT

A surface covering system is described which involves a series of interconnected tiles having a spline system located between the tiles to simulate the appearance of grout. Each tile has on its sides, at least one tongue section and at least two groove sections wherein the tongue section of one tile interconnects with the groove section of a second tile and further forms a gap at least at the upper surface between the two tiles. A first spline, having two tongue sections for interconnecting with the groove section(s) of at least one tile, is inserted between a series of tiles. A second spline capable of fitting into the gap formed between two or more tiles, which are interconnected at a tongue of a first tile and a groove of a second tile is further used. Methods of installing the surface covering system of the invention are further described.

28 Claims, 11 Drawing Sheets

U.S. PATENT DOCUMENTS 4,426,820 A 1/1984 Terbrack et al.
4,599,841 A * 7/1986 Haid ..... 52/586.2 X
4,644,720 A * 2/1987 Schneider ..... 52/392 X
4,759,164 A 7/1988 Abendroth et al.
4,769,963 A 9/1988 Meyerson
5,052,158 A 10/1991 D'Luzansky
5,295,341 A 3/1994 Kajiwara
5,349,796 A 9/1994 Meyerson
5,694,730 A * 12/1997 Del Rincon et al. ..... 52/586.1
5,797,237 A 8/1998 Finkell, Jr.
5,833,386 A 11/1998 Rosan et al.
D406,360 S 3/1999 Finkell, Jr.
6,006,486 A 12/1999 Moriau et al.
6,023,907 A 2/2000 Pervan

SURFACE COVERING SYSTEM AND METHODS OF INSTALLING SAME

BACKGROUND OF THE INVENTION

The present invention relates to surface coverings and more particularly to surface covering systems which include surface tiles and systems for joining the tiles together to form an overall surface covering.

Laminate flooring continues to grow in popularity as a flooring product due to its ease of installment as well as its performance. Furthermore, the various designs which arc available for laminate flooring also enhance its popularity with consumers since designs include wood-grain patterns, slate, marble, mosaic, granite, and the like. The use of such laminate flooring generally involves not only emulating the appearance of the slate, marble, and the like, but further requires emulating the joints which exist between the various tiles.

Conventional ways of making simulated grout tiles include using printed grout that becomes part of the overall tile product. In other words, the simulated grout is printed onto a tile along with the simulated design of the marble, slate, and the like. Another method of simulating grout tiles is to apply hot melt or liquid grout materials to fill the gap between two tiles. However, these conventional methods of simulating grout have many disadvantages. For instance, the printed grout has a fake appearance and therefore does not simulate grout very well. In particular, the printed grout is on the same plane as the tiles, and even though the grout may be embossed with a different texture, there is still no differentiation with the plane of the grout and the printed pattern such as marble or slate. In addition, printing grout along with a design of slate or marble, for instance, leads to low manufacture efficiency and yield because to cut the square tiles from a big laminate board requires expensive sensors to register the printed board to the cutting saw. Furthermore, there is little tolerance allowed with aligning the board for proper cutting and the dimensional growth of the printed paper in both longitudinal and latitudinal direction during the impregnation process makes the registration cutting even tougher.

Furthermore, with a liquid grout system, the material consists of polymers and carriers wherein the material becomes solid after the carrier is evaporated. Needless to say, there are many problems associated with liquid systems. Further, they are very labor intensive and pose a problem with clean-up since a person must manually apply this material to the gap between the material. Furthermore, there have been concerns that the liquid material can be too soft after curing and therefore may not withstand performance requirements. In addition, the intersection between four floor tiles ("+" intersection), can be a problem and messy since there is distortion in the liquid grout being applied. Also, some liquid fillers can cause staining of the top surface of the tiles. For instance, conventional cement base ceramic tile grout, an example of a liquid type grout material, is difficult to apply and to clean up, and the application of the grout is very labor intensive and time consuming.

With hot melt type heat weld systems, such as thermoplastics, hot melt grout is a solid material at room temperature and thus needs to be liquefied by heating. Also, there can be slight distortion at the "+" joints and some pin holes in the finished grout which can be unacceptable both from a visual and maintenance perspective. The pin holes are caused by the evaporation of entrapped moisture and/or gas from the extrusion process of making the hot melt rod.

Accordingly, there is a need to provide a grout system for all types of surface coverings using tiles that can overcome one or more of the difficulties described above.

SUMMARY OF THE INVENTION

A feature of the present invention is to provide a surface covering system that is inexpensive to apply and is not labor intensive.

Another feature of the present invention is to provide a surface covering system that is more realistic with respect to the grout areas, and provides a three-dimensional look.

Another feature of the present invention is to provide joints for grout which are capable of being sealed by various means, such as heat welding, solvents, adhesives, or other techniques, such as ultrasonic or electromagnetic systems.

Another feature of the present invention is to provide a system which overcomes the difficulty of applying a simulated grout look to the gap between tiles.

Additional features and advantages of the present invention will be set forth in the following description, and in part will be apparent from the description, or may be learned by practice of the present invention. The objectives and other advantages of the present invention will be realized and obtained by means of the elements and combinations particularly pointed out in the written description and appended claims.

To achieve these and other advantages and in accordance with the purposes of the present invention, as embodied and broadly described herein, the present invention relates to a surface covering system. The surface covering system includes a series of tiles wherein each tile has at least one tongue section and at least two groove sections, for example, one tongue section and three groove sections. The tongue section of one tile interconnects with a groove section of a second tile wherein when the two tiles are interconnected a gap is formed at least on the upper surface between the two tiles. The surface covering system further includes a first spline having two tongue sections for interconnecting with the groove sections of at least two tiles. Also, the surface covering system includes a second spline capable of fitting into the gap formed by two or more tiles. This second spline is located between two or more tiles which are interconnected at a tongue of a first tile and a groove of a second tile.

The present invention further relates to a method for installing a surface covering system such as the one described above. This method of installing a surface covering system of the present invention involves connecting a series of tiles together to form a line, wherein the tiles are connected together at the tongue of one tile and the groove of another tile and so on. A tongue section of a first spline is then inserted into the grooves of two or more tiles in this series of tiles. The groove of a second series of tiles is then connected into the other tongue section of the first spline. The second series of tiles is further connected to each other to form a line by connecting the tongue of one tile to the groove of another tile and so on. The second spline is inserted into each of the gaps formed between the tiles wherein this second spline may be arranged in a perpendicular direction to the first spline when a system of square or rectangular tiles are used for the system. When other shapes of tiles are used, such as diamond-shaped tiles, the first and second splines are not necessarily perpendicular to each other. Once inserted, the second spline can be bonded, melt-bonded, adhered, or cured in order to be permanently located between the tiles.

It is to be understood that both the foregoing general description and the following detailed description are exemplary and explanatory only and are intended to provide further explanation of the present invention, as claimed.

The accompanying drawings, which are incorporated in and constitute a part of this application, illustrate several embodiments of the present invention and together with the description, serve to explain the principles of the present invention.

DETAILED DESCRIPTION OF THE PRESENT INVENTION

The present invention relates to a surface covering system, preferably involving a series of tiles with spline joints located between the tiles. The spline joints preferably simulate grout or mortar. The present invention further involves a method of installing the surface coverings.

Figure 4A:
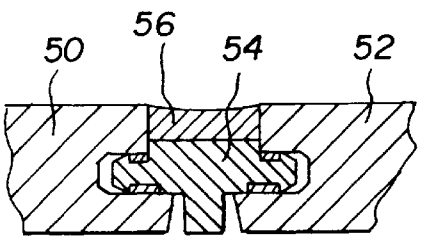
FIGS. 4(*a*) and (*b*) through FIGS. 6(*a*) and (*b*) are partial side views of various tiles of the present invention showing the tongue and/or groove sections of the tiles along with the first spline sections (FIGS. 4*a*, 5*a*, and 6*a*) and the second spline sections (FIGS. 4*b*, 5*b*, and 6*b*) which can be inserted between two or more tiles.
Figure 4B:
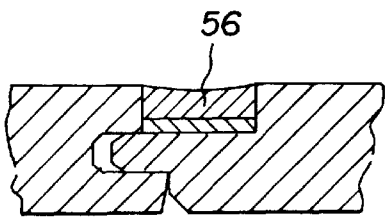
Figure 9A:
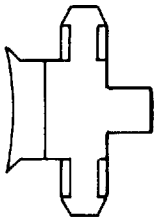
Figure 9B:
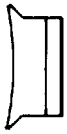
Figure 8A:
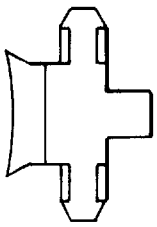
Figure 8B:
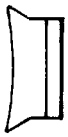
Figure 7A:
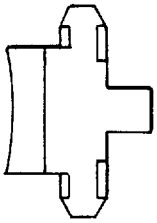
FIGS. 7(*a*) and (*b*) through FIGS. 9(*a*) and (*b*) are side views of the first and second spline sections, which can have a variety of designs.
Figure 7B:
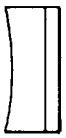

In more detail, the surface covering system, as shown in FIGS. 4*a* and 4*b*, has a series of tiles 50, 52, a first spline section 54 and a second spline section 56, which are all interconnected. The tiles that are used are such that each tile preferably has four sides, a top surface and a bottom surface. Three of the sides have groove sections and the other side has a tongue section. The tongue section of one tile interconnects with a groove section of a second tile. Furthermore, the tongue and groove sections are designed such that when they interconnect with each other, a gap is formed in the upper surface between the two tiles in order to receive a spline section as will be described in more detail below.

The tiles preferably have four sides and are preferably rectangular in shape, for example, square. Tiles of other shapes, including triangles, hexagons, octagons, pentagons and other polygons can be used. Combinations of tiles of different shapes can also be used in the flooring system of the present invention, such as a combination of octagon shapes and square shapes. Preferably, the tiles are of such shape or shapes that when a row or line of tiles are connected together, a continuous row or line of groove sections is provided and adjacent tiles of the row or line can share the same first spline.

The tiles can be made of any material that can be used for surface coverings. For instance, the tile can be a laminate tile, which is a particle board having various layers located on top including a print layer having a design to simulate granite, wood, brick, and the like. Any design can be used on the print layer. The tile can also be made of a polymeric material such as a thermoplastic material. Generally, any thermoplastic material, combinations thereof, alloys thereof, or mixtures of two or more thermoplastics can be used to form the tile. Generally, such thermoplastic materials include, but are not limited to, vinyl containing thermoplastics such as polyvinyl chloride, polyvinyl acetate, polyvinyl alcohol, and other vinyl and vinylidene resins and copolymers thereof; polyethylenes such as low density polyethylenes and high density polyethylenes and copolymers thereof; styrenes such as ABS, SAN, and polystyrenes and copolymers thereof; polypropylene and copolymers thereof; saturated and unsaturated polyesters; acrylics; polyamides such as nylon containing types; engineering plastics such as acetyl, polycarbonate, polyimide, polysulfone, and polyphenylene oxide and sulfide resins and the like. One or more conductive polymers can be used to form the tile, which has applications in conductive flooring and the like. The thermoplastic polymers set forth in Kirk Othmer ($3^{rd}$ Edition, 1981) at pp. 328 to 848 of Vol. 18 and pp. 385–498 of Vol. 16, (incorporated in their entirety by reference herein) can also be used as long as the resulting tile has sufficient strength for its intended purpose.

The surface covering system of the present invention can be used as floor coverings, wall coverings, ceiling coverings, kitchen countertops, and the like.

The tiles used in the present invention can be of any size including conventional sizes. For instance, the tiles can range in size of from about 2"×2" (50.8 mm×50.8 mm) to about 48"×48" (1219.2 mm×1219.2 mm), and more preferably from about 6"×6" (152 mm×152 mm) to about 24"×24" (609.2 mm×609.2 mm), and most preferably from about 12"×12" (304.8 mm×304.8 mm) to about 16"×16" (406.4 mm×406.4 mm). The thickness of the tile can be any conventional thickness such as from about 0.158" (4 mm) to about 0.472" (12 mm) and more preferably from about 0.276" (7 mm) to about 0.355" (9 mm.).

Figure 20:
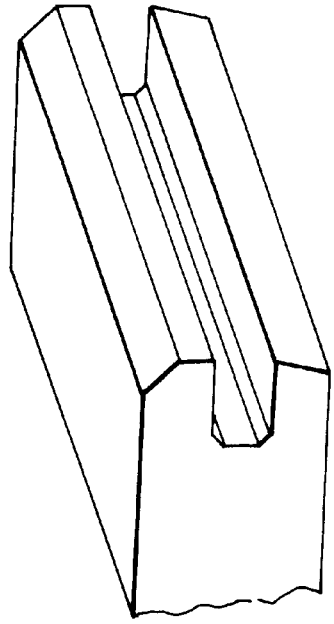
FIG. 20 is a perspective view of a tile shown in FIG. 19.
Figure 19:
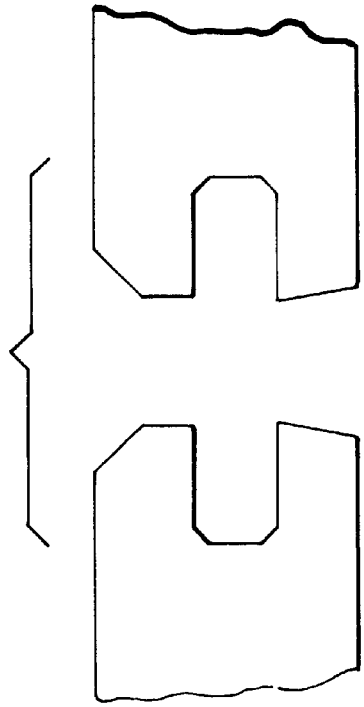
FIG. 19 is a two dimensional view showing a partial side view of two tiles and opposing groove portions of each.
Figure 23:
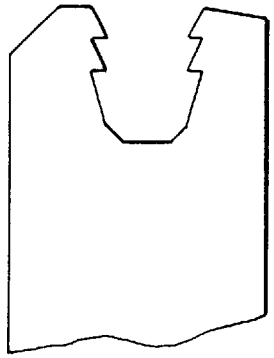
FIGS. 21 through 23 are partial side views of various designs of grooves that can be present in the tiles of the present invention.
Figure 22:
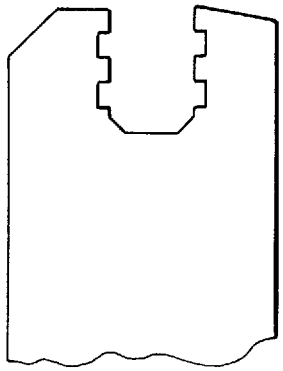
Figure 21:
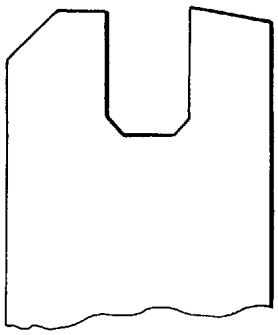
Figure 24:
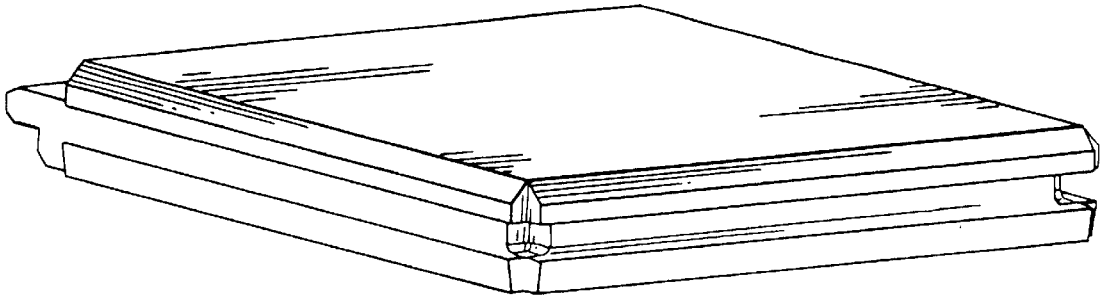
FIG. 24 is a perspective view of a tile having three sides with grooves and one side with a tongue section.
Figure 25:
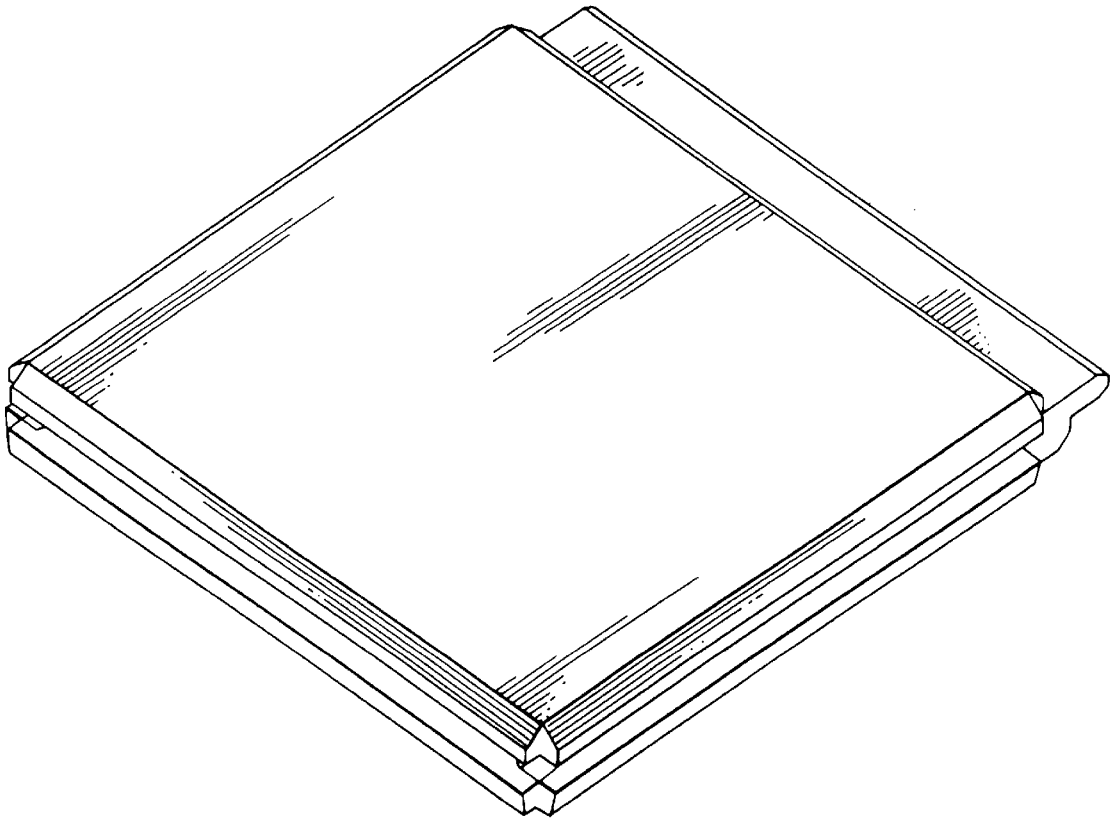
FIG. 25 is a perspective view of a tile further showing the tongue section of the tile, as well as the groove sections.
Figure 27:
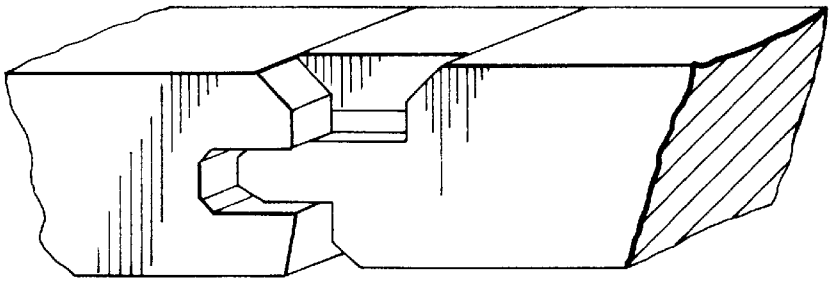
FIG. 27 is a perspective view of the assembly shown in of FIG. 26.
Figure 26:
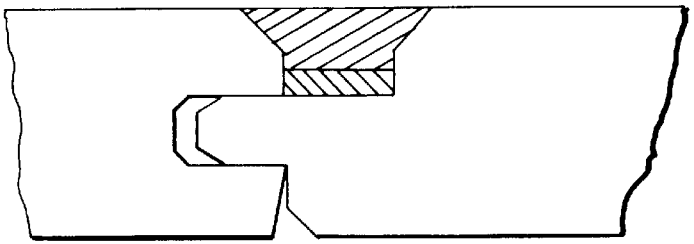
FIG. 26 is a side view of an assembly having a second spline lying in a gap formed between two tiles.
Figure 28:
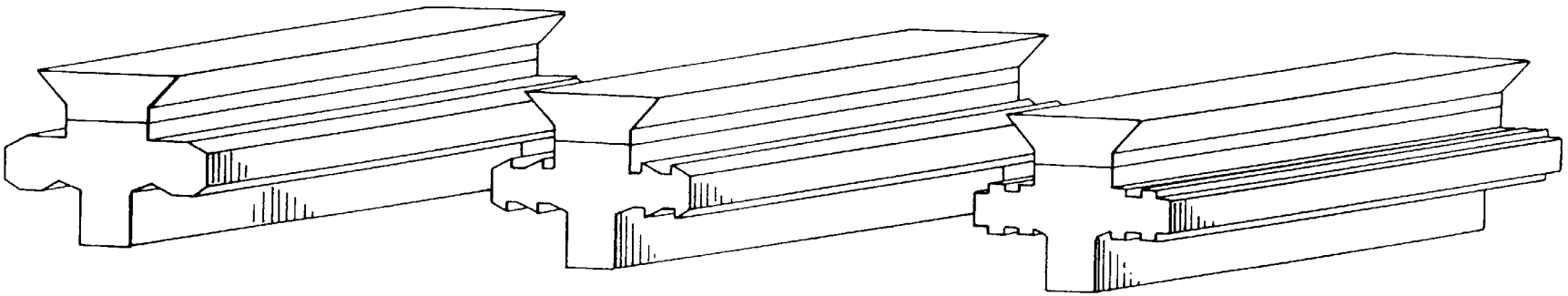
FIG. 28 is a perspective view of three designs of the first spline section.

With respect to the groove section that is preferably on three sides of the tile, these groove sections can be of any dimensions as long as the receiving tongue section can either be inserted into the groove section of a second tile in order to connect two or more tiles, or inserted into a spline section to be discussed below. The groove sections on three sides of the tiles generally are located in the middle portion of the side of the tile and the height of the recessed portion forming the groove section is from about 0.095" to about 0.255", and more preferably from about 0.098" to about 0.102". The depth of the recessed portion, that is, how far the groove is recessed into the side of the tile, is from about 0.1500" to about 0.210", and more preferably from about 0.1800" to about 0.1900". Preferably, the groove section runs along the entire length of each of three sides of each tile. The recessed portion can have a variety of designs to interface with the receiving tongue section. For instance, as shown in FIGS. 19 and 20, the groove section can be in the form of a sideways letter "U" and can have various angular cuts as represented in FIGS. 19 and 20. Other designs of the groove are further set forth in FIGS. 21 through 23 where FIG. 21 also shows a smooth groove in the shape of a sideways letter "U". FIG. 22 shows a tooth-like groove and FIG. 23 shows a recessed groove also having teeth. FIG. 24 further depicts the sides of a preferred tile wherein it can be seen that the grooves run the entire length of three sides of the tile and the fourth side has a tongue section as more clearly shown in FIG. 25. FIGS. 26 and 27 depict how the tongue portion of one tile connects with the groove section of a second tile.

Figures 1A, 1B, 1C, 2A, 2B, 2C, 3A, 3B, 3C:
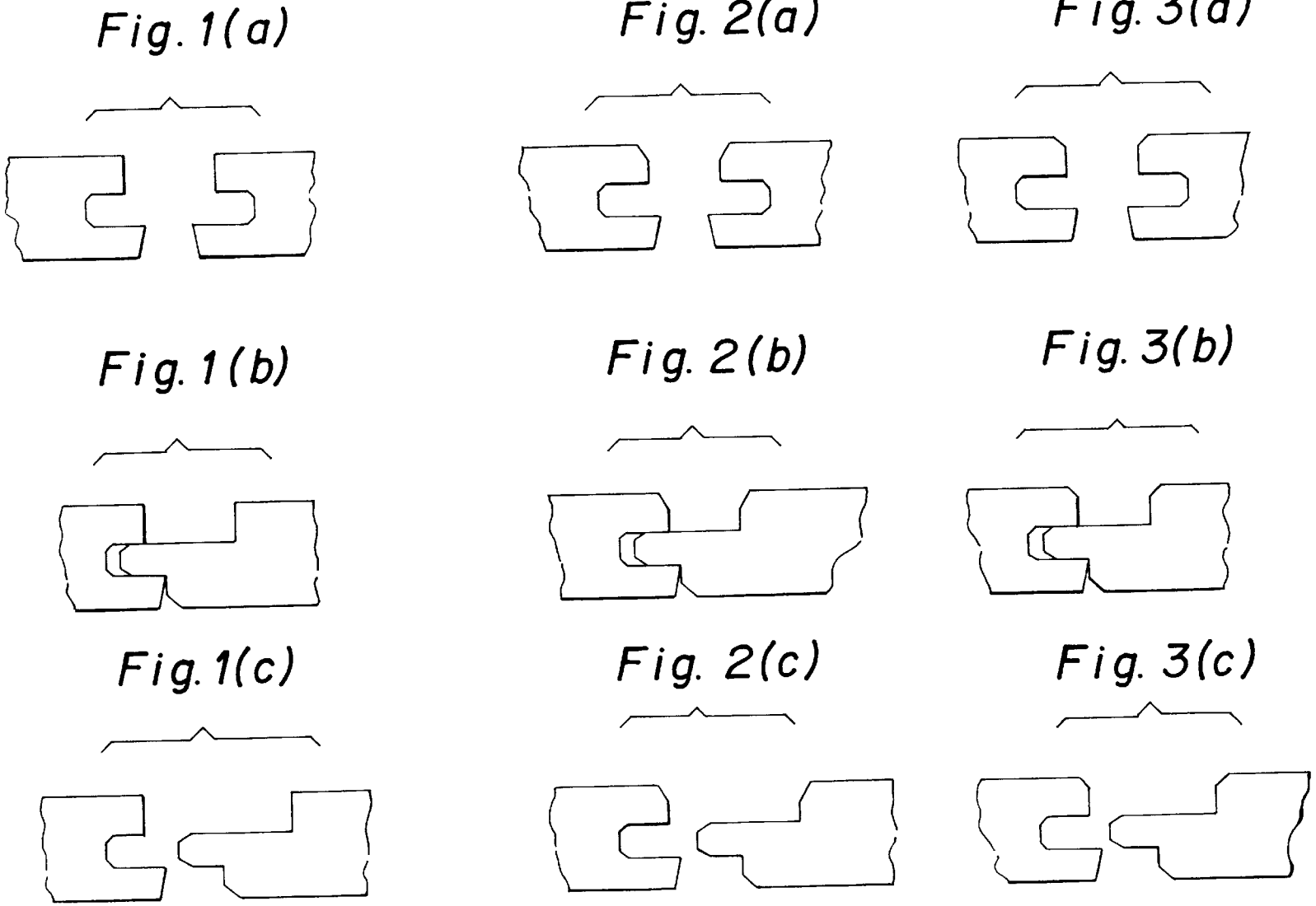
FIGS. 1(*a*), (*b*), and (*c*) through FIGS. 3(*a*), (*b*), and (*c*) are partial side views of various tiles of the present invention and show the groove and/or tongue portion of the tiles of the present invention.
Figure 6A:
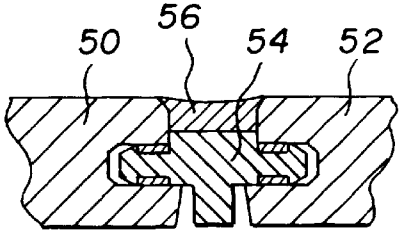
Figure 6B:
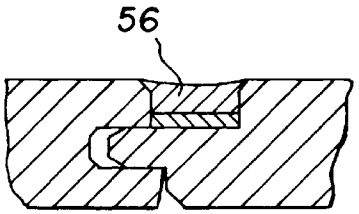
Figure 5A:
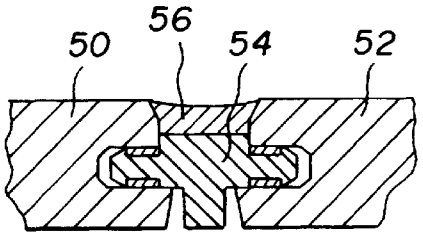
Figure 5B:
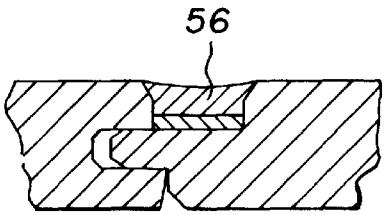

As shown in FIGS. 1 through 3, the groove section of the tile can have various angular cuts. For instance, as shown in FIG. 2(*a*), the tile near, the upper surface of the sides, has a tapered cut on each side in order to form a more defined trapezoidal gap between two tiles when they are interconnected as shown in FIG. 2(*b*). FIG. 3(*a*), likewise, shows a tapered upper side section wherein the length of the tapered cut is shorter.

Figure 12:
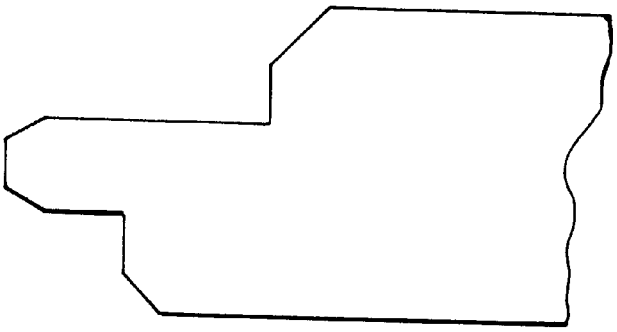
FIG. 12 is a two dimensional view showing a partial side view of a tongue portion of a tile.
Figure 13:
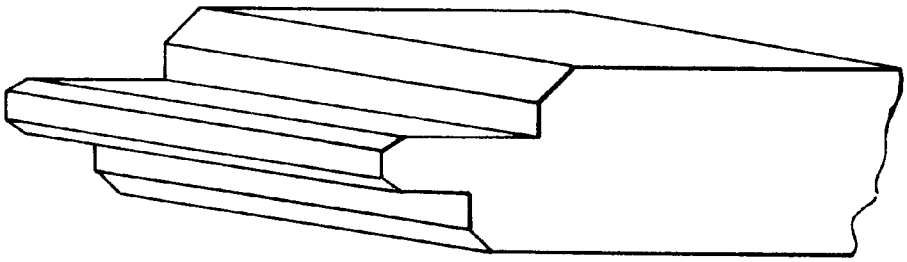
FIG. 13 is a perspective view of the same portion of the tile as shown in FIG. 12.

With respect to the tongue section of each tile, as stated above, the tongue section is designed such that it will interconnect with a groove section of a second tile. FIGS. 12 and 13 provide a preferred design of the tongue section where it can be seen that preferably the upper surface of the tongue is more recessed than the lower portion as shown in FIG. 12. Generally, the upper surface will be twice as exposed as the lower surface in forming the tongue portion. The thickness of the actual tongue portion which inserts into the groove will preferably be of a size to snugly and tightly fit into the groove in order to interconnect the two tiles together. Accordingly, the tongue portion will have very similar thicknesses to the height of the recessed portion and can be as long as the depth of the recessed portion. The tongue and groove are designed such that when the two interconnect, a gap is formed as shown in FIGS. 1(*a*), 2(*a*), and 3(*a*).

Figure 29:
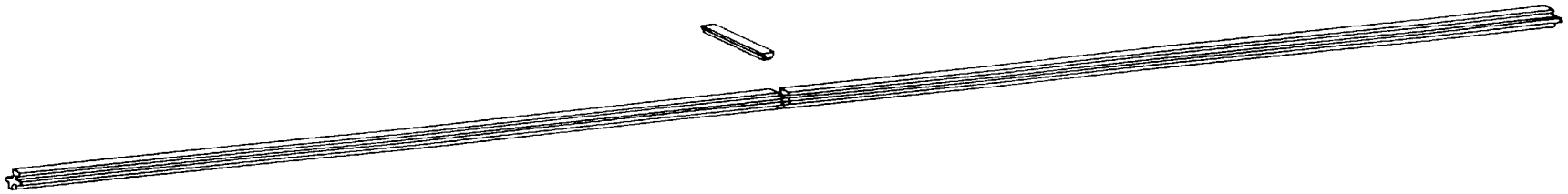
FIG. 29 is a perspective view of a long first spline having a notch formed therein for receiving the second spline.

The surface covering system of the present invention is preferably designed such that a series of tiles are interconnected to form a straight line of tiles. The tiles are connected with each other by fitting the tongue of one tile into the groove of another tile and so on. This line of tiles then has a groove section on each side of the series of tiles forming the line. A first spline is then designed to have two tongue sections on each side. Each of these tongue sections is designed to interconnect with one or more groove sections of tiles. Preferably, the first spline is designed to have a length such that it interconnects with the groove sections of at least two tiles and more preferably with at least three tiles. The spline section can be designed to have a length such that it can interconnect a line of tiles from two tiles to twelve tiles or more. The first spline section as depicted, for instance, in FIG. 29, is designed such that there are one or more intermittent notches present on the upper surface of the first spline. This notch is of sufficient width and depth to receive a second spline on top such that when the second spline is placed in the notch, the upper surfaces of the first and second splines are even with one another. These notches are intermittently present in design to address the gaps which form a "+" intersection between multiple tiles, such as four tiles. Thus, the notches are preferably spaced apart according to the length of each tile.

Figure 10:
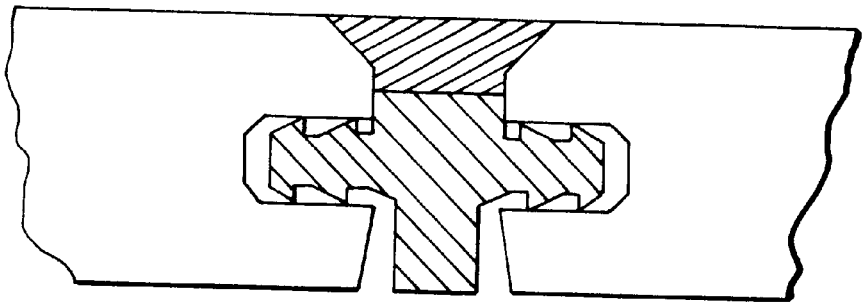
FIG. 10 is a two dimensional view of an assembly having a first spline inserted into the grooves of a square tile.
Figure 11:
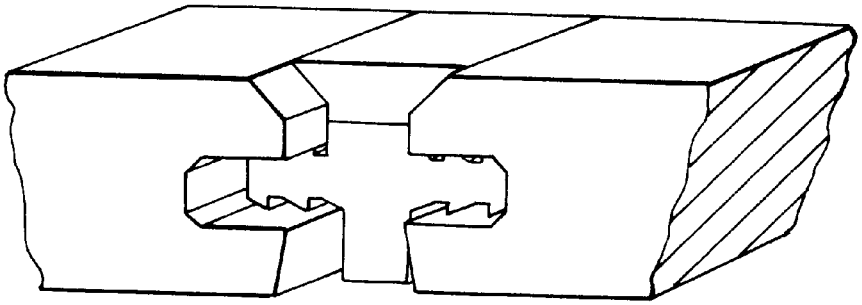
FIG. 11 is a perspective view of the assembly of FIG. 10.

The designs of the tongue sections of the first spline can be of the same design, essentially, as the tongue section of the tiles. Various designs are set forth in FIGS. 4(*a*) through 6(*a*). As can be seen in these figures, the groove sections of two tiles are interconnected by means of the first spline which preferably is of a design such that the bottom surface of the first spline rests between the bottom surfaces of the first tile and second tile being interconnected. Preferably, the upper and lower surfaces of the tongue sections of the first spline comprise a soft polymer in order to ensure a tight fit between the groove sections of the tile. The tongue sections of each first spline are designed so as to have a thickness and depth that will generally match the height and depth of the groove sections of the tiles. Furthermore, the upper surface of the first spline preferably has a concave surface in order to simulate the concave surface of grout. This can be seen in FIGS. 4(*a*) through 6(*a*). The interaction of the first spline with two tiles is further set forth in FIGS. 10 and 11. Generally, the first spline can simply be connected with the groove sections of two or more tiles. However, adhesives or other bonding material can further be applied to the tongue sections of the first spline, as well as to the tongue and/or groove sections of any of the materials in order to ensure a more permanent connection.

Figure 14:
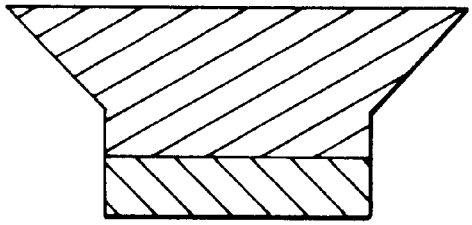
FIG. 14 is a two dimensional view showing a second spline design.
Figure 15:
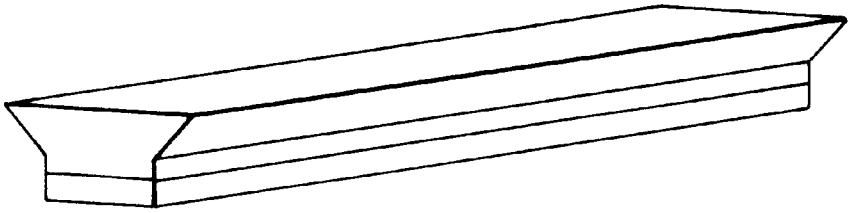
FIG. 15 is a perspective view of the spline of FIG. 14.

As indicated earlier, a second spline is used in this surface covering system to simulate the same grout or mortar simulated by the first spline. The second spline fills in gaps between tiles that run perpendicular or at an angle to the first spline, as can be seen in FIG. 29. This second spline fits over the gap created by the interconnection of the tongue section of one tile and the groove section of a second tile as shown in FIGS. 1(*b*) through 3(*b*). The second spline does not have any tongue or groove sections, but instead is a piece of material that simply fits between the gap created by two connecting tiles. One preferred design having a type of trapezoidal shape is set forth in FIGS. 14 and 15. This spline can be placed over the gap running perpendicular to the first spline and, as indicated earlier, can be of such a length that it fits over notches located on the first spline at every intersection of four tiles. This second spline is simply inserted or placed into the gap and then can be permanently affixed by various techniques. For instance, insertion of the second spline can be made permanent by application of adhesive material such as glues; by hot welding; or methyl ethyl ketone, methyl amyl ketone, dipropyl ketone, methyl isobutyl ketone, n-methyl pyrrolidone, dimethyl formamide, cyclohexanone, nitrobenzene, and the like.

The second spline can be of any length and preferably has a length equal to at least one tile or tile and half, and more preferably at least two tiles, but can be the length of one tile to twelve tiles or more. The material used to make the second spline is generally the same type of polymeric material used to make the first spline. The upper surface of the second spline can also be concave as shown in FIGS. 4(*b*) through 6(*b*). Again, this is done to simulate the appearance of grout or mortar.

Generally, any sequence of steps can be used to insert the tiles, and the first and second splines. One way of installing the surface covering system, which can be done in any order, involves connecting a series of tiles to essentially form a line, wherein the tiles are connected together at the tongue of one tile and the groove of another tile opposite its tongue, and so on, to form a row or line of tiles. The tongue section of a first spline can then be inserted into the series of grooves formed on one side of the line of tiles. A second series of tiles can then be formed and inserted, by way of one series of grooves, into the other tongue section of the first spline. Again, the second series of tiles are also connected to each other by connecting the tongue of one tile to the groove of another tile to form a straight or essentially straight line or series of interconnected tiles. These steps can be repeated in any order to connect any number of tiles together. The second spline can then be inserted into each of the gaps formed between the various tiles wherein these gaps, as indicated earlier, would be running perpendicular to the first spline in the case of rectangular tiles, or otherwise running at an angle to the first spline as with diamond-shaped tiles.

As an option, adhesive or other supplemental bonding material or means can be used during any of these above-described steps to more permanently attach the tiles together and to the spline system. The second spline can then be permanently affixed to the tiles by adhesive material, hot welding devices, melt-bonding, solvents, ultrasonic or electromagnetic techniques, and the like.

Preferably, to join two tiles with a first spline having the length of two tiles, the first spline is inserted with one half of the length of the spline in the groove of one tile and the other half in the groove of an adjacent tile in a series of tiles.

For rectangular tiles, the longitudinal ends of the tiles are preferably grooved, and one of the latitudinal ends is grooved, and the other latitudinal end has the tongue portion. The groove configuration of the latitudinal end is the same as the groove configurations of the longitudinal ends. The length of the upper tongue on the tile is equivalent to the size of the grout width plus the typical size of a tongue portion inserted in the groove.

Preferably the length of the first spline is equivalent to the length of two tiles plus the widths of the grouts between the two tiles. One benefit of the present invention is that the spline does not have to be precisely dimensioned in length prior to installation and can be cut to the exact size during installation. In the tile assembly, the first spline is preferably designed such that when it is the length of two tiles plus grout width, it will be aligned to the first tile thus ensuring a perfect alignment for the latitudinal grout material to lie across in the traverse or perpendicular direction. Since both ends of the first spline are cut or centered to the middle of the notch, great flexibility is provided to cover any possible variation of tile dimension. For instance, if the first spline is shorter than the tile size at the end, a small gap may exist from one spline to the next spline. However, the simulated grout top portion of the second spline, which is laid on top, can disguise any possible gaps.

The splines can be made of any thermoplastic material like vinyl containing thermoplastic such as polyvinylchloride, polyvinylacetate, polyvinylalcohol, and other vinyl and vinylidene resins and copolymers thereof. Other examples of suitable thermoplastic materials include, but are not limited to, polyethylene, such as low density polyethylenes and high density polyethylenes and copolymers thereof; styrenes such as ABS, SAN, and polystyrenes and copolymers thereof; polypropylene and copolymers thereof; saturated and unsaturated polyesters; acrylics and polyamides, such as nylon; engineering plastics such as acetyl, polycarbonate, polyimide, polysulfone; polyphenylene oxide; sulfide resins; and the like.

Figure 18:
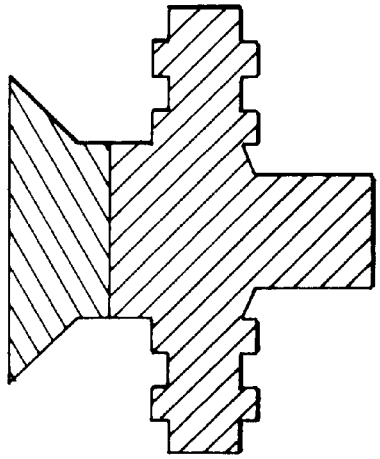
FIGS. 16 through 18 represent cross-sectional views of various designs of the first spline.
Figure 17:
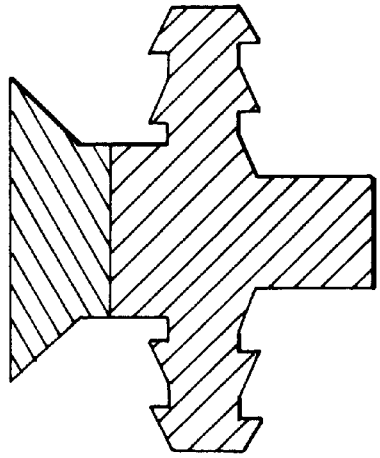
Figure 16:
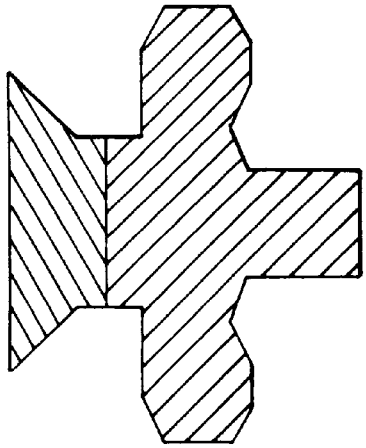

The first spline can preferably comprise a substantially rigid bottom portion and a top portion which is more flexible and/or of lower melting material than the bottom section. Cross-sectional profiles of two-portion first splines are shown in FIGS. 16–18. Likewise, the second spline may comprise a bottom portion and a top portion. The top portion of the second spline may be more flexible and/or of lower melting material than the bottom portion thereof. Preferably, the top portion of the first spline and the top portion of the second spline are of the same material.

The first spline may be provided with a connecting device at an end thereof so that the first spline can be connected to another first spline to form a substantially continuous length of first spline. Likewise, the second spline may be provided with a connecting device at ends thereof to enable connecting two or more second splines together. The connecting device for connecting like splines together may be of tongue and groove design, of toothed tongue and notched groove design, or of a like design.

As a further embodiment, the first spline may be a two piece system, wherein the top portion of the first spline is separate from the bottom portion having the two tongue sections. The top portion of the first spline can be installed just like the second spline is installed. This type of embodiment permits any defects between splines to be masked by the top portion of the first spline when placed on top of the lower portion of the first spline. Further, in this embodiment, the length of the upper portion of the first spline can be different from the length of the bottom portion of the first spline.

The present invention will be further clarified by the following examples, which are intended to be purely exemplary of the present invention.

EXAMPLES

Example 1

Solvent Welding Method

JOWAPUR 13 687 00 was sprayed onto the entire surface of the tongue and grooves of the laminate flooring as shown in FIGS. 24 and 26. JOWAPUR 13 687 00, from Jowat Adhesives, is a hydrophobic material, a foam free polyurethane pre-polymer without residual tack. The viscosity of this material is approximately 40 cps. The sealer preferably penetrates into the HDF and also totally seals the entire surface of the tongue and groove. The spray rate was approximately 0.3 grams to 0.5 grams per tile that has one tongue on one side of three grooves on the rest of three sides of the square tile format. The dimensions of the square tile were 15.71"×15.71" (399 mm×399 mm). The sealer that was sprayed on all four edges of each square tile was allowed to cure for 24 hours.

Lengthwise spline material (composed of rigid and semi-rigid PVC) was then inserted into the grooves of two tiles to interconnect them together. The tongue section of these tiles was also inserted into the groove section of the second tiles to form a larger square tile assembly that consisted of four tiles interconnecting them together by using both spline and tongue & groove locking system.

The widthwise spline was then snapped into the recessed areas created by the tongue and groove connection of the tiles.

Solvent sealer, THF, was then applied by using an applicator with conical shape or syringe that had a tip of 1/32" in diameter on the top of a 4 oz. bottle. The application rate of THF seam sealer along all joints between tiles in lengthwise and widthwise was about 0.20 grams to 0.70 grams per board.

The tiles were allowed to sit for 8 hours to develop bond strength between the square tiles and spline system. The bond strength for separating the tiles from the joint was about 131 psi.

Example II

Heat Welding Method

The laminate was the same as Example 1 and was pre-treated with pre-polymer and cured in the same manner as in Example 1.

The lengthwise spline material, based on Exxon's Escorene LD 723 (composed of low density polyethylene/vinyl acetate copolymer), was then inserted into the groove section of the second tiles to form a larger square tile assembly that consisted of four tiles interconnecting them together by using both spline and tongue & groove locking grooves of two tiles to interconnect them together. The tongue section of these tiles was also inserted into system.

The widthwise spline that was also made out of Exxon's Escorene LD 723 (composed of low-density polyethylene/vinyl acetate copolymer) was snapped into the recessed areas created by the tongue and groove connection of the tiles.

A heat gun was then used to soften and subsequently melt the edges of the spline material and thus initiate bonding between the spline and tile board surface. The surface temperature of the spline reached about a minimum of 185° F. (85° C.). Bond strength was then achieved between the square tile and spline system.

The joint was allowed to be completely cooled down for the full strength of the bond to be developed between the square tile and spline system. The bond strength for separating the tiles from the joint was about 37 psi.

Other embodiments of the present invention will be apparent to those skilled in the art from consideration of the specification and practice of the present invention disclosed herein. It is intended that the specification and examples be considered as exemplary only, with the true scope and spirit of the present invention being indicated by the following claims.

What is claimed is:

1. A surface covering system comprising a series of tiles, each tile having an upper surface, a lower surface, and a plurality of sides, wherein at least two of the sides each have a groove section and at least one of the sides has a tongue section; wherein when the tongue section of one tile interconnects with the groove section of a second tile, a gap is formed on the upper surface between the two tiles;

at least one first spline having two tongue sections for interconnecting with the groove sections of at least two tiles;

at least one second spline capable of fitting into said gap formed between two or more tiles which are interconnected at the tongue section of one tile and the groove section of another tile.

2. The surface covering system of claim 1, wherein the top edges of each tile are tapered.

3. The surface covering system of claim 1, wherein the top edges and bottom edges of each tile are tapered.

4. The surface covering system of claim 1, wherein said first spline and said second spline simulate grout in appearance.

5. The surface covering system of claim 1, wherein said first spline and said second spline comprise thermoplastic material.

6. The surface covering system of claim 1, wherein the upper top surfaces of said first spline and said second spline are concave.

7. The surface covering system of claim 1, wherein the tongue section of said first spline has a tooth-like design.

8. The surface covering system of claim 1, wherein the tongue section of each tile has a tooth-like design.

9. The surface covering system of claim 1, wherein said first spline has a design such that the bottom of said first spline rests between the bottom surfaces of the first tile and said second tile.

10. The surface covering system of claim 1, wherein said groove sections of each tile have a tooth-like design.

11. The surface covering system of claim 1, comprising two or more first splines connected together.

12. The surface covering system of claim 1, wherein the sides having a groove section is longer at the bottom portion than the top surface portion of the same groove.

13. The surface covering system of claim 1, wherein the tongue sections of said first spline have soft polymer located at top and bottom surfaces of the tongue to be inserted into the groove section of said tiles.

14. The surface covering system of claim 1, wherein said first spline has a notch located on the top surface to receive said second spline.

15. The surface covering system of claim 1, wherein a series of notches are spaced apart on the top surface of said first spline by lengths equivalent to about one tile length.

16. The surface covering system of claim 1, wherein said surface is a floor.

17. The surface covering system of claim 1, wherein said surface is a wall, ceiling, or countertop.

18. The surface covering system of claim 1, wherein said tile has a printed design on the top surface thereof.

19. The surface covering system of claim 1, wherein said tile has a printed layer on top of each tile and has the design of brick, granite, slate, marble, mosaic, or wood-grain patterns.

20. The surface covering system of claim 1, wherein each tile has four sides, three of the sides have groove sections, and one side has a tongue section.

21. The surface covering system of claim 1, wherein said series of tiles includes at least two tiles of different shapes.

22. The surface covering system of claim 1, wherein said series of tiles includes rectangular or square tiles.

23. The surface covering system of claim 1, wherein said first spline comprises a separate top portion and a separate bottom portion, wherein said top portion is affixed to said bottom portion.

24. A method of installing the surface covering system of claim 1, comprising:

connecting two or more of said tiles together to form a row of tiles, wherein the tiles are connected together by connecting the tongue section of one tile and the groove section of another tile;

inserting a tongue section of said first spline into a groove section of one or more tiles in said row of tiles;

connecting a groove of at least a third tile into the other tongue section of said first spline;

connecting a tongue section or a remaining groove section of said third tile to a groove section or a tongue section of a fourth tile to form a second row of tiles;

inserting at least one of said second spline into each of said gaps formed between said tiles that are not otherwise occupied by said first spline; and affixing the inserted second splines.

25. The method of claim 24, wherein said second row of tiles is formed before said third tile is connected to said first spline.

26. The method of claim 24, wherein said third tile is connected to said first spline and then said second row of tiles is formed.

27. The method of claim 24, wherein said affixing comprises melt-bonding.

28. The method of claim 24, wherein the steps are repeated one or more times.

* * * * *